US008899645B2

(12) United States Patent
LeBlanc

(10) Patent No.: US 8,899,645 B2
(45) Date of Patent: Dec. 2, 2014

(54) UNIVERSAL FLANGE LIFTER DEVICE

(76) Inventor: Adam LeBlanc, DeQuincy, LA (US)

( * ) Notice: Subject to any disclaimer, the term of this patent is extended or adjusted under 35 U.S.C. 154(b) by 37 days.

(21) Appl. No.: 13/439,005

(22) Filed: Apr. 4, 2012

(65) Prior Publication Data

US 2013/0264835 A1 Oct. 10, 2013

(51) Int. Cl.
*B66C 1/28* (2006.01)
*B66C 1/62* (2006.01)

(52) U.S. Cl.
USPC ..... 294/82.13; 294/106

(58) Field of Classification Search
USPC ..... 294/81.56, 82.1, 82.13, 67.31, 85, 206, 294/110.1, 118, 902; 248/309.1
See application file for complete search history.

(56) References Cited

U.S. PATENT DOCUMENTS 3,337,256 A * 8/1967 Shropshire, Jr. ..... 294/82.1
4,221,419 A * 9/1980 Riley et al. ..... 294/106
4,530,536 A 7/1985 Williams
5,064,334 A 11/1991 Cooley
5,065,984 A 11/1991 Hake
5,344,207 A 9/1994 Grimm
5,566,999 A * 10/1996 Goettl ..... 294/103.1
5,613,721 A * 3/1997 Mullins ..... 294/82.1
5,842,729 A 12/1998 Bunn
6,581,996 B1 * 6/2003 Fromelius ..... 294/89
8,434,800 B1 * 5/2013 Leblanc ..... 294/82.1
8,434,801 B2 * 5/2013 Leblanc ..... 294/82.13
2013/0106124 A1 * 5/2013 Leblanc ..... 294/67.31

* cited by examiner

*Primary Examiner* — Paul T Chin
(74) *Attorney, Agent, or Firm* — Daniel Boudwin; Global Intellectual Property Agency LLC

(57) ABSTRACT

A universal lifting device adapted to lift and support large pipe flange assemblies during installation and removal. The lifting device is hoist-supported and comprises a first and second member rotatably connecting to a common support pin. The rotatable members are elongated dog-bone sections offset from one another along the pin, rotatable along parallel planes and adapted to be positioned on opposing sides of a flange. The members connect to the pin at their proximal end, while their distal end allows a lifting bolt to be positioned therethrough and into an eye of the flange. Two lifting bolts are utilized to support the flange during deployment, while the common pin is supported by a crane hoist and the two members are offset using a plurality of spacers to prevent binding. The lifting bolts are secured using a hingeable latch that prevents their dislodgement from the distal end of each rotatable member.

15 Claims, 3 Drawing Sheets

UNIVERSAL FLANGE LIFTER DEVICE

BACKGROUND OF THE INVENTION

1. Field of the Invention

The present invention relates to an improved means for lifting and rigging pipe flanges into position onto a pipe end. More specifically, the present invention pertains to a device for lifting medium to large blind and weld neck flanges into position for installation in a way that improves worker safety and control of the flange during installation or removal.

2. Description of the Prior Art

Many industries utilize piping systems to facilitate daily operations. For example, oil refineries, gas companies and sewage treatment facilities need to pump and store large volumes of gases and/or liquids. The transport and storage systems for these products are large and are designed for durability and safety, as any leaks could be extremely hazardous and costly. Typically, piping systems are connected together at various junctions and joints to prevent such leaks. Piping systems generally comprise an array of individual segments that connect together to form an entire network for transporting a substance therethrough. The present invention pertains specifically to pipe flange fittings and a tool to aid installation and removal thereof. Pipe flanges are utilized to secure a pipe closed or to weld a new section of equal diameter piping to a pipe end. These fittings are generally considerably heavy and cumbersome components that require specific techniques and safety precautions when installing or removing. Their size and weight necessitates the use of a mechanical lift device, such as a crane or mechanical hoist, in order to property rig the flange into place during installation, or to control the flange during removal.

Blind flanges are flat, disk-like covers that affix over the ends of open pipes. They are often difficult to lift and position because of their weight and their shape. A traditional procedure for lifting such a flange involves inserting a chain or lifting bolt through an eye of the flange and then using the chain or hoist to lift the flange. This method is highly hazardous to worker safety because any broken link in the chain could result in the flange becoming loose and falling to the ground. This method further does not provide the level of stability necessary for a safe installation, as a chain or single lifting point does not guarantee the device will not rotate while being positioned. The use of ad hoc tools or impromptu support means is both dangerous for personnel and to the equipment being utilized. The instability of such a support also introduces a pinching risk for workers operating near the suspended flange and the pipe end, whereby clothing and limbs may be compressed therebetween if the flange is not securely supported. Worker safety is paramount in such work environments and around construction sites, as accidents can lead to considerable injury to those involved if adequate precautions are not taken and appropriate tools are not utilized.

Weld neck flanges are similar to blind flanges; however these offer a long, tapered hub surrounding an open central region, wherein the hub distal end is used to weld a connecting pipe thereto utilizing a buttweld joint. This type of flange allows for connection of an equal diameter pipe to be welded to the hub using the buttweld joint, which creates a join that is well suited for high pressure applications and extreme temperature fluctuations. These types of flanges, as with all pipe flanges, employ a plurality of securement bolt eyes around their perimeter. The weld neck flange protruding hub, however, extends from its central region and limits the ability of workers to place a lifting tool beneath a pair of lifting bolts fitted through the eyes of the flange during installation or removal. This prohibits a worker's ability to support a lifting bolt from the hub-side of the flange, which limits the stability and safety of an operation in which the flange is supported from only from one side.

The present invention is disclosed for the purposes of supporting any a plurality of industrial fittings, including any type of flange having one or a plurality of eyes, regardless of the flange central hub geometry. The present invention employs a pair of pivotable members that are positioned on opposing sides of the flange and are utilized to support lifting pins placed through the flange eye locations. A pair of pins and the flange eyes are supported by the members in a static configuration, whereafter a mechanical lift hoists the assembly into position if the flange is being installed. During removal, the two securement bolts from the flange installation are removed and the remaining connections are loosened to separate the flange from the pipe end while still retaining connectivity. The separation allows a user to position the present invention members on opposing sides of the flange. The support pins are fitted through the two open eyes to support the flange as all remaining bolts are removed, allowing the flange to be stably supported and controlled once the flange is free of the pipe. The pivotable members do no overlap any major portion of the flange central region, other than the eye locations, allowing for its use in conjunction with blind, lap joint, slip-on, socket weld, threaded or weld neck flanges.

Several specialized devices exist in the market and in the prior art that facilitate the lifting of heavy industrial assembly components. These devices have familiar design elements for the purposes of supporting an article using a crane hoist, wherein the supported element is otherwise unwieldy or cumbersome to handle. However, these devices fail to disclose the novel features of the present invention, and are limited to a specific use outside of the scope of supporting pipe flanges and other industrial assemblies having lifting eyes. These prior art devices include those that have been patented or published in patent application publications. The devices deemed most relevant to the present disclose are provided below.

Specifically, U.S. Pat. No. 4,530,536 to Williams describes a set of lifting tongs for use in conjunction with a crane for lifting I-beams. The device is designed for use by a single individual. The tongs are opened and closed by the operation of a pneumatic piston at the upper end of the set of tongs. A set of jaws exists at the lower ends of the tongs having a groove cut into the interior face of each jaw. The grooves are specifically designed to catch the edges of the top flange of an I-beam. A crane operator lowers the lifting tongs device around the sides of the beam that is to be lifted. The crane operator then operates the closing mechanism of the tongs. As the tongs close, the jaws come together to secure against the upper flange of the beam. The jaws are designed so that as the jaws are closing, if the crane operator slowly lifts the device with the crane hoist, the jaws catch the edges of the top flange of the beam within the jaw grooves.

The Williams device is particularly designed for the purpose of lifting I-beams. While the Williams device serves an important function by lifting such beams, the device could not be used for lifting pipe flanges. The jaw and groove mechanism employed by the Williams device for catching the top edge flanges of an I-beam could not be used to grip the edges of a blind flange or support a pair of lifting bolts attached thereto, since the diameter of a blind flange is very likely to exceed the span of the top edge flanges of an I-beam and the tongs are not adapted to support the two bolts in a secure and stable manner.

U.S. Pat. No. 5,065,984 to Hake is another device that describes a clamp assembly device for lifting pins out of concrete forms. When concrete is poured, the outer edges of what is poured must be shaped into the desired form. A concrete form is typically a metal frame that is made from smaller segments of the form combined together to make the overall form of the concrete slab to be laid. The smaller portions of the frame fit together like puzzle pieces—connected to one another and held together via pins. The device attaches to a lifting mechanism, which can be a piece of industrial equipment that allows for an upward lifting element that facilitates lift needed when using the disclosed device. The lifting mechanism is important when using the Hake device properly as the pins must be removed from the concrete forms by pulling directly upward. Pulling the pins any direction other than vertically will damage the pin, the concrete form, or both. While suited for its particular requirement, the Hake device is limited to lifting concrete form pins. The present invention provides a lifting mechanism for use with a lifting mechanism, such as a crane or hoist, and is particularly suited for lifting pipe flanges into position for attachment onto a large pipe assembly or pipe end, or further for removal thereof.

U.S. Pat. No. 5,344,207 to Grimm describes an apparatus for lifting tires that is used in conjunction with a lifting device, such as a crane. The device comprises two members for gripping a tire and a means for connecting to a crane. The first member is stationary, while the second member is movable. The second member has two positions: a tire lifting position and a tire non-lifting position. To use the device, a tire is placed between the two members when the second member of the device is in the non-lifting position. Once the tire is in properly placed in the device, the second member is moved by a user to the tire lifting position and locks into place so that the tire is gripped by the two members of the device.

Similar to the Grimm device is U.S. Pat. No. 5,064,334 to Cooley, wherein an apparatus for lifting large tractor tires is disclosed. The size of tractor tires makes them difficult to maneuver without the assistance of a lifting device. The Cooley device aims to lift and move tractor tires easily. When a tractor tire is standing upright on the tread, the Cooley device attaches to the tire by an attachment means. The tire attachment means connects to a boom, which is raised and lowered by a hand jack. The boom connects to a base and the boom is also capable of being pivotally rotatable to facilitate moving of the tractor tire from one point to another. One embodiment of the tire attachment means is a square-shaped clamp. The arms of the clamp extend around the sides of the tractor tire with the ends of the clamp arms wrapping under the rim of the tire so that when the clamp is closed around the tire, the tire is caught in the clamp. The boom can then be lifted, lifting the attached tractor tire with it by operating the hand jack.

Both the Grimm and Cooley devices are specifically suited for lifting tires. Each device employs a clamping mechanism is designed to grip, lift and suspend a tire. The clamping mechanisms of the Grimm and Cooley devices do not support the tire from below its structure in any way. The clamps merely pinch under the tire carcass such that the clamps encircle the sidewall and enter through the wheel opening. While it is unlikely, if the clamping mechanism of either the Grimm or Cooley devices were to fail, the tire would release or drop from the grip of the device. Such an accident could harm an individual or damage property. The present invention differs in spirit and intent from the Grimm and Cooley device and is particularly suited for lifting large objects having lifting eye locations, such as pipe flanges and similar industrial equipment.

U.S. Pat. No. 5,842,729 to Bunn describes a device for lifting large sections of heavy pipe. The device comprises a pair of lifting tongs that attach to a crane hoist or other lifting means. The tongs have two ends and are connected to each other at a pivot point. The bottom end of each tong curves inward towards the center of the tongs such that as the tongs close, they wrap around the cylindrical shape of the pipe cross section being moved. The top end of each tong connects to the other by a highly durable cable. The cable is looped through a lifting means, such as a crane hoist or a forklift. As the crane hoist or forklift rises, it pulls upward on the cable connecting the two top ends of the tongs, causing the top ends of the tongs to move towards one another. The tongs are positioned in a scissor configuration, wherein the cable action on the tongs compresses the working ends of the tongs around a pipe section. As the top ends of the tongs move towards each other, the bottom ends also compress towards each other, wrapping around the section of cylindrical piping. These tongs are not suited for adequately lifting or supporting lift bolts of a flange. The scissor action provides lateral compression but inadequate support under the flange bolts, which is necessary for safely and securely lifting a blind flange. The present invention provides a means to support a pipe flange and lift bolts fitted through eyes of the flange such that a secure and safe lifting assembly is provided.

The present invention provides an industrial lifting tool having a pair of rotatable members that are rotatably connected and offset from one another via a common pin attachment. The members employ an aperture through which is adapted to be placed a lifting bolt inserted therethrough and into an eye along the periphery of an industrial flange assembly. The members attaches along opposing sides of the flange and provide a stable support means that resists dislodgement during lifting and pipe end fitting operations. Spacers along the common pin provide the offset between members, while the tool itself is separable into its base elements to accommodate long common pins and more or fewer spacers thereon. The spacers prevent the rotatable members from binding or creating pinch points along the pin. In light of the foregoing prior art the elements of the present disclosure, it is submitted that the present invention substantially divergent from existing lifting devices, and consequently it is clear that there is a need in the art for an improvement to existing flange lifting devices. In this regard, the instant invention substantially fulfills these needs by providing a universal lifting device.

SUMMARY OF THE INVENTION

In view of the foregoing disadvantages inherent in the known types of universal lifting device now present in the prior art, the present invention provides a new industrial lifting tool wherein the same can be utilized for providing convenience for the user when lifting industrial assemblies having eyelets utilizing a crane or mechanical hoist.

It is therefore an object of the present invention to provide a new and improved universal lifting device that has all of the advantages of the prior art and none of the disadvantages.

It is another object of the present invention to provide a universal lifting device that is crane or hoist supported for the purposes of supporting a large industrial fitting having a plurality of eye lift points.

Another object of the present invention is to provide a universal lifting device that supports industrial flanges using a pair of lifting eyes, whereby the eyes are supported using lifting bolts that connect to rotatable members of the lifting device.

Yet another object of the present invention is to provide a universal lifting device that securely attaches to a pipe flange and resists dislodgement, and one that further is disassemblable to accommodate different sized flanges and types.

A final object of the present invention is to provide a universal lifting device of rugged construction, such that its use in an industrial or construction environment does not compromise its long-term performance.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
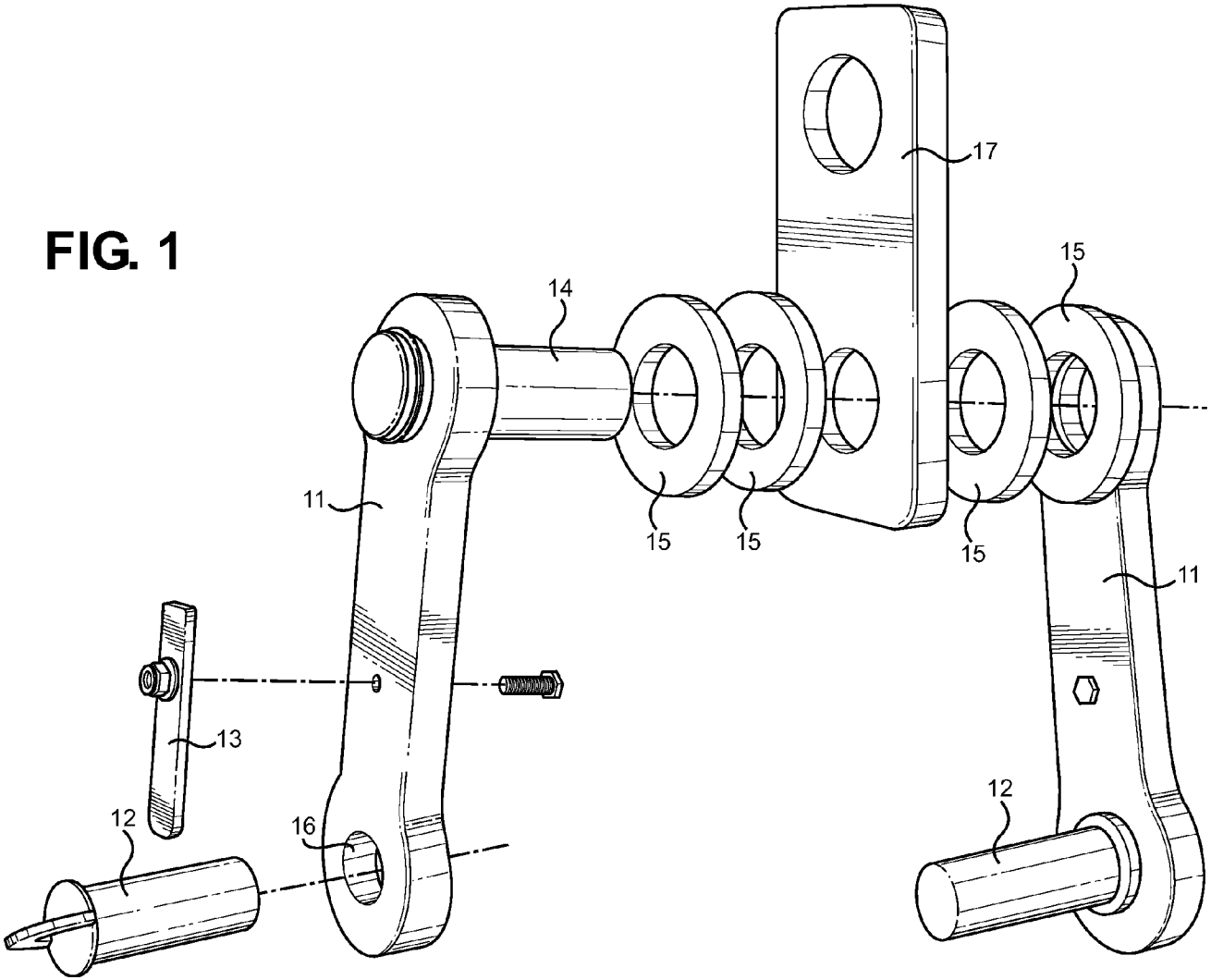
FIG. 1 shows an exploded perspective view of the present invention, highlighting its components.

Reference is made herein to the attached drawings. Like reference numerals are used throughout the drawings to depict like or similar elements of the universal lifting device. For the purposes of presenting a brief and clear description of the present invention, the preferred embodiment will be discussed as used for lifting blind and weld neck flange assemblies. The figures are intended for representative purposes only and should not be considered to be limiting in any respect.

Referring now to FIG. 1, there is shown an exploded perspective view of the universal lifting device of the present invention. The device comprises two pivotable members 11 that are rotatably connected to a common pin 14 for the purposes of creating a rotatable clevis fitting adapted to secure over the edge of a pipe flange. The members 11 are elongated sections having a proximal end that is rotatably attached to the common pin 14 and a distal end that employs a lifting bolt hole 16 for while to position a lifting bolt 12 therethrough. Two elongated members 11 connect to the pin at a given offset distance therealong and are capable of rotating in two parallel planes about their pinned connection to the common pin 14. Located along the common pin length is a hoist fitting 17 that allows the assembly to be lifted by a crane or mechanical hoist, and further a plurality of spacers 15 which position the rotatable members 11 along pin 14 and prevent them from moving therealong. The spacers 15 further prevent the members 11 from binding or creating point points, as the spacers 15 ensure the members 11 remain perpendicularly positioned with respect to the pin 14 length. The hoist fitting 17 is an elongated arm that employs a first and second aperture to first secure to the support pin 14 and allow a crane hook or clevis pin to fit therethrough. In an alternate form, the hoist fitting may employ a first aperture to accept said pin 14 and a clevis fitting and clevis pin along its upper portion to allow connection to a crane hook or similar device.

The assembly is positioned over the outer edge of a pipe flange, which includes a plurality of securing fastener bolt locations, or eyes, in a radial pattern along its outer periphery. The members 11 are positioned on opposing sides of the flange such that the lifting bolt holes 16 align with two distinct flange eyes. A lifting bolt 12 is then fed through the each bolt hole 16 and corresponding flange eye to secure the assembly together. The rotatable members form a triangular frame that is statically positioned in connection with the flange to provide a stable and sturdy hoist tool that connects to a crane or mechanical hoist via the hoist point 17. To ensure the lifting bolts 12 remain in position while the flange and tool are being hoisted, a securing latch 13 is provided that slides over the end of the lifting bolt 12 once positioned in the tool. The latch 13 rotates in and out of the way, and prevents the bolt from 'backing-out' once positioned through the rotatable member and flange eye, while the bolt 12 head prevents the bolt 12 from sliding completely therethrough. In an alternate embodiment of the present invention, a single pivotable member is provided along the pin 14 to form a singular attachment point for the flange; however this configuration is less stable than that preferred embodiment, which employs two pivotable members forming a triangular lifting frame.

Figure 2:
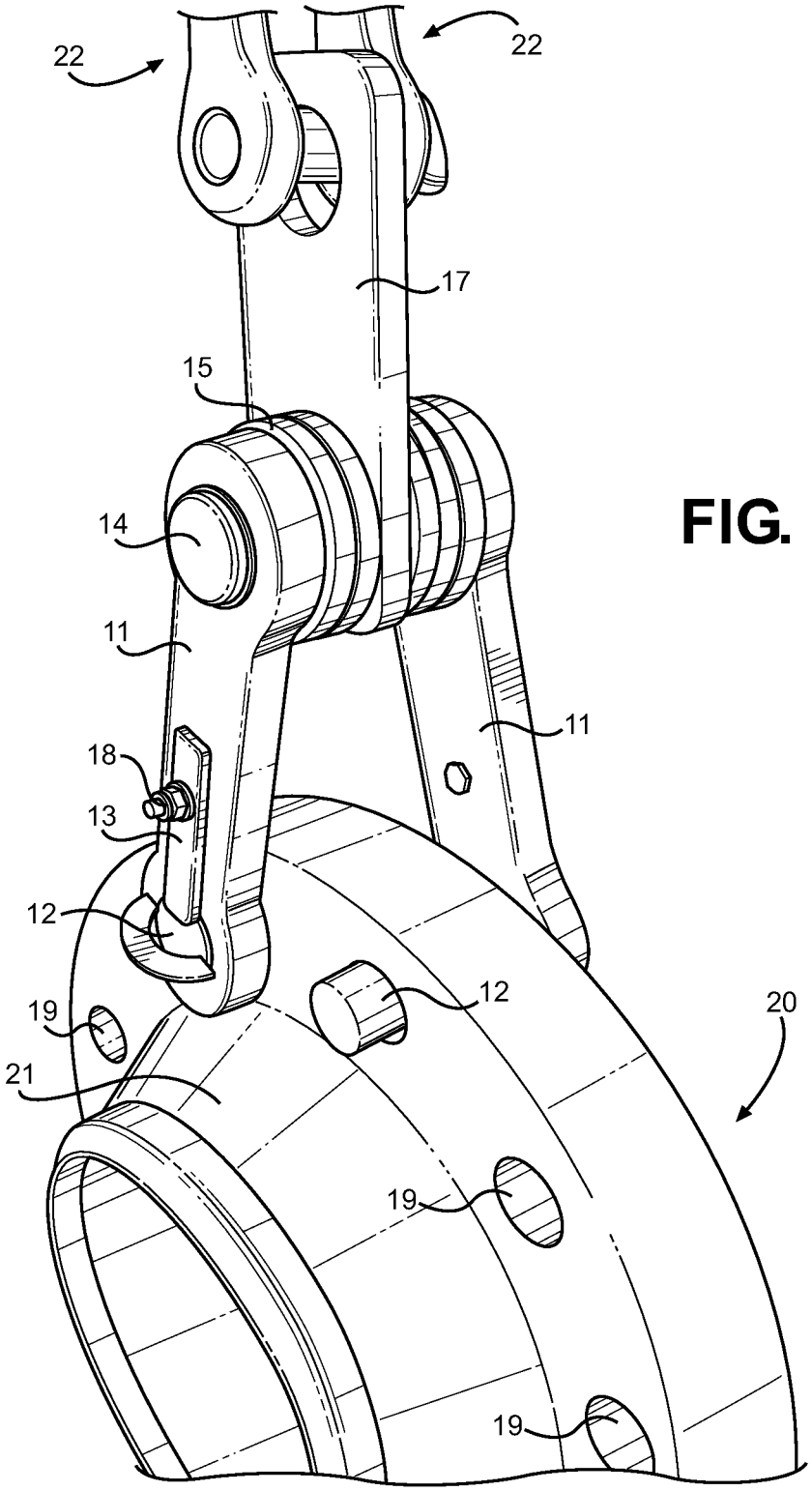
FIG. 2 shows an overhead perspective view of the present invention in a working state, attached to a weld neck flange and being supported by a crane hoist.

Referring now to FIG. 2, there is shown an overhead perspective view of the present universal lifting device of the present invention in a working state, supporting a weld neck flange 20 and being lifted by a crane hoist 22. As shown, the lifting device provides a triangular frame when attached to two lifting points on the flange 20, wherein lifting bolts 12 are fed through the rotatable members 11 of the device and through concentric flange eye locations 19. This allows a crane or lift to support the assembly from the crane lift point 17 in a static, stable and predictable fashion, which improves worker safety and facilitates the swift removal or application of the flange. Once the lifting bolts 12 are inserted, the securing latch 13 is rotated over the end of the inserted bolt 12. The latch 13 rotates from a connection point 18 along the length of the rotatable member 11 to cover the end of the bolt 12 and secure its position in the flange eye. The rotatable members 11 themselves are positioned on opposing sides of the flange 22, are separated by a given distance to provide clearance around the flange thickness and offset by individual spacers 15 along the common pin 15. The spacers 15 can be added or removed as necessary to allow for larger or smaller flange gauges, as the pin 14 and members 11 are disassemblable from one another. This provides a modular tool that can accommodate different flange sizes. The rotatable members 11 are secured along the pin 14 and prevents from sliding from the ends of the pin by an attached retaining ring, cotter pin or similar removable bearing member.

The present invention provides rotatable members 11 covering a small area along the flange periphery when in place. The distal ends of the members terminate at the flange eye locations, which allows the present tool to the be utilized with a number of different industrial or construction situations, wherein the geometry of the flange or industrial assembly does not create interferences that would prevent its use. Particularly for pipe flanges, the present invention can be deployed with weld neck flanges and similar flanges having outwardly projecting interior geometry. For weld neck flanges, the tapering hub 21 is an obstruction for traditional lifting tools that are utilized to fit beneath inserted lifting bolts, as hub 21 clashes with the supporting portion of the lifting tool. The present invention is not concerned with the interior geometry of the flange, as the pivoting members 11 do not create an interference with the outwardly projecting hub 21. Similarly, any industrial assembly that provides two lifting eyes may benefit from the present invention. It is therefore not contemplated to limit the present lifting tool to the application of lifting flanges, but rather it is desired to disclose a universal lifting tool. The present tool has been tested and proven its value as a secure flange assembly lifter, but has applications in a broad range of industries.

Figure 3:
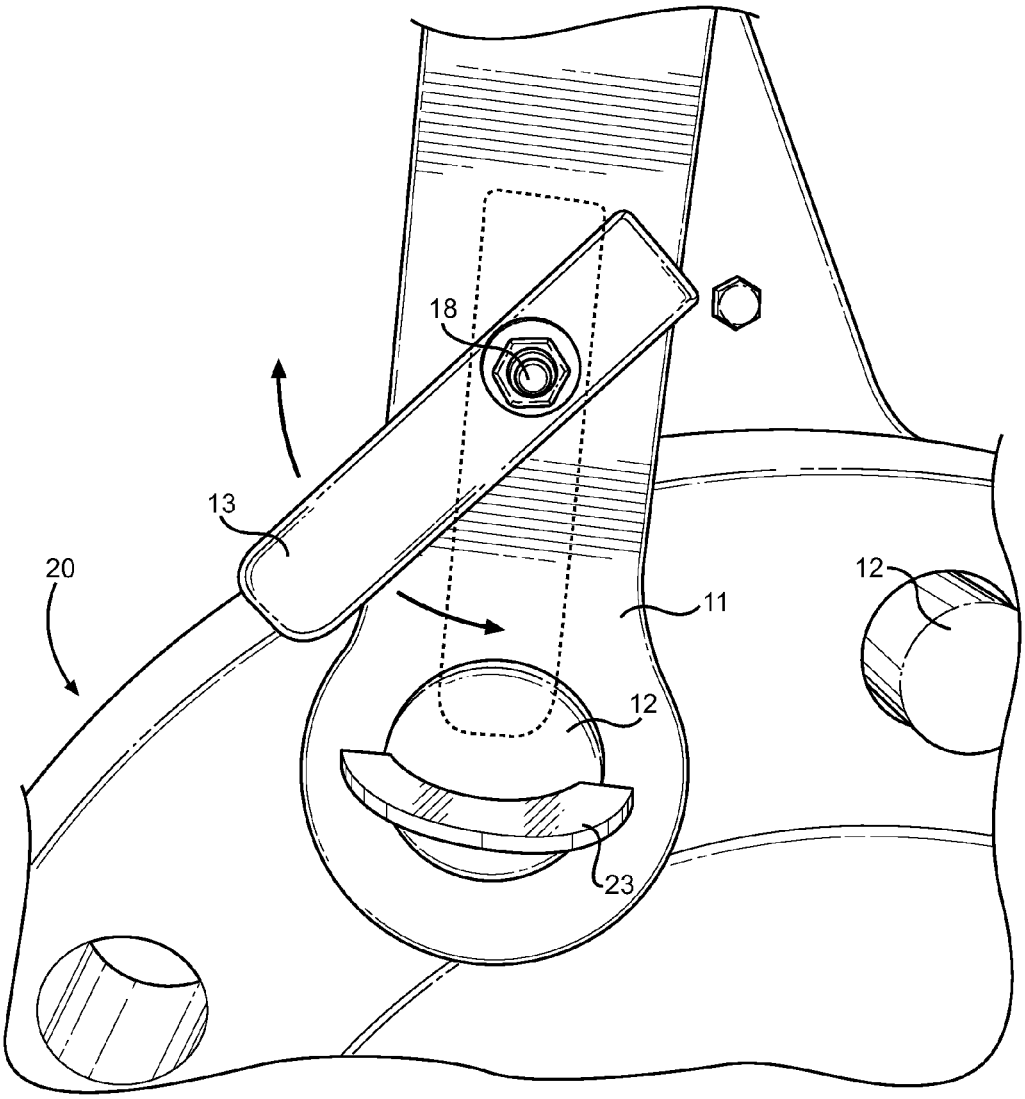
FIG. 3 shows a close-up view of the present invention connection to the flange eye location, wherein a lifting bolt is secured through the rotatable member and flange eye.

Referring now to FIG. 3, there is shown a close-up view of the connection between the present lifting tool and the outer periphery of an industrial flange 20. Also shown is the action of the securement latch 13, which rotates about a pivot location 18 along the rotatable member 11 to secure a lifting bolt 12 positioned therethrough. The latch 13 fits over the end of the bolt 12 and prevents dislodgement. The lifting bolt 12 preferably comprises an elongated shank having a head region, where the head region includes an upstanding handle 23 to provide a user a grasping location for insertion or removal of the lifting bolt 12 from said lifting bolt hole during flange fitting and removal operations. Once the bolts 12 have been positioned through the flange eyes and through the rotatable members 11, the assembly is locked in connection with the flange. Drastic movements and flailing of the assembly will not dislodge the bolts or the tool from the flange, which is a critical safety requirement when handling such large articles. When positioning the flange or removing it from a pipe, the flange must be controlled to prevent injuries and workplace hazards.

In use, the present lifter is very well suited for positioning pipe flanges over a pipe end. The members are connected to the flange using the lifting bolts and the assembly is then suspended using a crane hoist. The flange is then positioned against an open pipe end. Several securing bolts are then fed through the flange open eyes and through corresponding bolt locations on the open pipe end receiving hub and loosely engaged with securing nuts. This allows the tool to be temporarily connected to the hub and allows the lifting tool to be removed. The latches are moved out of the way and the lifting pins are removed from the flange, allowing the rotatable members to be free of the flange and lifted away. The flange is then loosely bolted to the pipe hub, and can be pressed thereagainst prior to placing the remaining securing bolts therethrough and the bolts to be torqued to their specifications.

Overall, it is desired to disclose a universal lifting device that employs two rotatable members that support removable and securable lifting bolts, wherein the entire assembly can be disassemblable and supported by a larger crane hoist during operation. In light of the present disclosure and the foregoing prior art devices, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A universal lifting tool, comprising:

a first and second elongated member having a proximal and distal end;

each elongated member proximal end being pivotably connected to a support pin, separated by an offset distance along said pin and mounted perpendicularly to said pin length;

each elongated member distal end having a lifting bolt hole to support a lifting bolt inserted therethrough;

a hoist fitting between said first and second elongated member along said support pin.

2. The device of claim 1, wherein said elongated members are able to rotate in two parallel planes, said planes being perpendicular to said pin length.

3. The device of claim 1, wherein said lifting bolts are adapted to be inserted through each elongated member bolt hole and through concentric lifting eyes of a flange to position said elongated members so as to create a triangular frame.

4. The device of claim 1, wherein said elongated members further comprise a lifting bolt securing latch that rotatably covers said lifting bolt head once positioned in said lifting bolt hole to secure its position.

5. The device of claim 1, wherein said lifting bolts further comprise an elongated shank and a head region, said head region further comprising an upstanding handle to provide a user a grasping location for insertion or removal of said lifting bolt from said lifting bolt hole.

6. The device of claim 1, wherein said hoist fitting further comprises an elongated arm having a first and second aperture, said first aperture adapted to accept said support pin and said second aperture adapted to provide connection for a crane or hoist.

7. The device of claim 1, wherein said hoist fitting further comprises an elongated arm having a first aperture and an upstanding clevis fitting, said aperture adapted to accept said support pin and said clevis adapted to provide connection for a crane or hoist.

8. The device of claim 1, further comprises a plurality of spacers along said support pin between said elongated member proximal ends and said hoist fitting.

9. A universal lifting tool, comprising:

a first elongated member having a proximal and distal end;

said elongated member proximal end being pivotably connected to a support pin and mounted perpendicularly to said pin length;

said elongated member distal end having a lifting bolt hole to support a lifting bolt inserted therethrough;

a hoist fitting along said support pin.

10. The device of claim 9, wherein said elongated member is able to rotate in a plane being perpendicular to said pin length.

11. The device of claim 9, wherein said lifting bolt is adapted to be inserted through said elongated member bolt hole and through a concentric lifting eye of a flange.

12. The device of claim 9, wherein said elongated member further comprises a lifting bolt securing latch that rotatably covers said lifting bolt head once positioned in said lifting bolt hole to secure its position.

13. The device of claim 9, wherein said lifting bolt further comprises an elongated shank and a head region, said head region further comprising an upstanding handle to provide a user a grasping location for insertion or removal of said lifting bolt from said lifting bolt hole.

14. The device of claim 9, wherein said hoist fitting further comprises an elongated arm having a first and second aperture, said first aperture adapted to accept said support pin and said second aperture adapted to provide connection for a crane or hoist.

15. The device of claim 9, wherein said hoist fitting further comprises an elongated arm having a first aperture and an upstanding clevis fitting, said aperture adapted to accept said support pin and said clevis adapted to provide connection for a crane or hoist.

* * * * *